United States Patent [19]

Jackson et al.

[11] Patent Number: 4,626,477

[45] Date of Patent: Dec. 2, 1986

[54] WEAR AND CORROSION RESISTANT COATINGS AND METHOD FOR PRODUCING THE SAME

[75] Inventors: John E. Jackson, Brownsburg; Thomas A. Adler; Jean M. Quets, both of Indianapolis, all of Ind.

[73] Assignee: Union Carbide Corporation, Danbury, Conn.

[21] Appl. No.: 831,325

[22] Filed: Feb. 20, 1986

Related U.S. Application Data

[63] Continuation-in-part of Ser. No. 546,542, Oct. 28, 1983, abandoned.

[51] Int. Cl.[4] ..... B32B 15/04; B32B 27/06; B05D 1/12

[52] U.S. Cl. ..... 428/457; 106/1.05; 420/431; 427/34; 427/422; 427/427; 427/436; 428/244; 428/472; 428/698; 428/699

[58] Field of Search ..... 428/404, 244, 472, 457, 428/698, 699, 546, 551; 427/34, 37, 427, 422, 436; 106/1.05; 420/431

[56] References Cited

U.S. PATENT DOCUMENTS

| | | | |
|---|---|---|---|
| 2,714,563 | 8/1955 | Poorman et al. | 428/472 X |
| 2,950,867 | 8/1960 | Hawley et al. | 427/427 X |
| 3,016,447 | 1/1962 | Gage et al. | 427/37 X |
| 3,421,890 | 1/1969 | Bäumel | 106/1.05 |
| 3,914,507 | 10/1975 | Fustakian | 428/404 |
| 4,519,840 | 5/1985 | Jackson et al. | 106/1.05 |

*Primary Examiner*—Thomas J. Herbert
*Attorney, Agent, or Firm*—Norman L. Balmer

[57] ABSTRACT

A coating composition applied to a substrate by a thermal spray process which consists essentially of from about 6.5 to about 9.0 weight percent cobalt, from about 2.0 to about 4.0 weight percent chromium, from about 3.0 to about 4.0 weight percent carbon and the balance tungsten.

30 Claims, No Drawings

WEAR AND CORROSION RESISTANT COATINGS AND METHOD FOR PRODUCING THE SAME

DESCRIPTION

RELATED APPLICATIONS

This application is a continuation-in-part of application Ser. No. 546,542, filed Oct. 28, 1983, now abandoned.

Application Ser. No. 546,480, of J. E. Jackson, et al. entitled "High Strength, Wear and Corrosion Resistant Coatings and Method for Producing the Same", filed Oct, 3, 1983, now U.S. Pat. No. 4,519,840, issued May 28, 1985, and copending application Ser. No. 546,541 , filed Oct. 28, 1983, now abandoned, of C. H. Londry, et al. entitled "Wear and Corrosion Resistant Coatings Applied at High Deposition Rates", disclose and claim subject matter which is related to the present application.

TECHNICAL FIELD

The present invention relates to wear and corrosion resistant coatings and to a method for producing such coatings. More particularly, the invention relates to a new family of W-Co-Cr-C coatings having improved strength and wear resistance.

BACKGROUND ART

Coatings of W-Co-Cr-C are used in those applications where both superior wear and corrosion resistance are required. A typical composition for these coatings comprises about 8 to 10 weight percent cobalt, about 3 to 4 weight percent chromium, about 4.5 to 5.5 weight percent carbon and the balance tungsten. These coatings can be successfully applied to various substrates, e.g., iron base alloy substrates, using known thermal spray techniques. Such techniques include, for example, detonation gun (D-Gun) deposition as disclosed in U.S. Patent Nos. 2,714,563 and 2,950,867, plasma arc spray as disclosed in U.S. Patent Nos. 2,858,411 and 3,016,447, and other so-called "high velocity" plasma or "hypersonic" combustion spray processes.

Although coatings of W-Co-Cr-C have been employed successfully in many industrial applications over the past decade or more, there is an ever increasing demand for even better coatings having superior strength and wear resistance. In the textile industry, for example, there is a need for special coatings of this type for use on crimper rolls subjected to extraordinary conditions of abrasive wear.

As is generally known, these coatings derive their wear resistance from the presence of complex carbides of W, Co, and Cr. It is also known that the wear resistance of the coating usually increases with any increase in the volume fraction of carbides. Therefore, it has been previously thought by those skilled in the art that a relatively high carbon content is necessary in order to obtain optimum wear resistance.

SUMMARY OF THE INVENTION

It has now been surprisingly discovered in accordance with the present invention that reducing the carbon content of the W-Co-Cr-C coatings described above to about 4.0 weight percent or less with the proper proportions of Co and Cr actually increases the wear resistance contrary to the teachings of the prior art. It has been found, however, that when too low a carbon content is employed, i.e., less than about 3.0 weight percent, then the resulting coatings are difficult, if not impossible, to grind to a smooth finish.

A coating composition (i.e., after application) in accordance with the present invention consists essentially of from about 6.5 to about 9.0 weight percent cobalt, from about 2.0 to about 4.0 weight percent chromium, from about 3.0 to about 4.0 weight percent carbon and the balance tungsten.

DESCRIPTION OF THE PREFERRED EMBODIMENTS

The coating powders of the present invention can be applied to a substrate using any conventional thermal spray technique. The preferred method of applying the coating powders is by detonation gun (D-Gun) deposition. A typical D Gun consists essentially of a water cooled barrel which is several feet long with an inside diameter of about 1 inch. In operation, a mixture of oxygen and a fuel gas, e.g., acetylene, in a specified ratio (usually about 1:1) is fed into the barrel along with a charge of powder to be coated. The gas is then ignited and the detonation wave accelerates the powder to about 2400 ft./sec. (730 m/sec.) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are about 1 inch (25 mm) in diameter and a few ten thousandths of an inch (microns) thick. Each circle of coating is composed of many overlapping microscopic splats corresponding to the individual powder particles. The overlapping splats interlock and mechanically bond to each other and the substrate without substantially alloying at the interface thereof. The placement of the circles and the coating deposition are closely controlled to build-up a smooth coating of uniform thickness and to minimize substrate heating and establishment of residual stresses in the applied coating.

The coating compositions of the present invention may be produced using essentially the same powder compositions as heretofore employed in depositing W-Co-Cr-C coatings of the prior art. However, in this instance, the oxy-fuel gas ratio employed in the D-Gun process is increased from a value of about 1.0 to a value of between about 1.1 and 1.2 . Under these conditions, chemical reactions during the coating process result in the desired coating composition.

It is also possible to use other operating conditions with a D-Gun and still obtain the desired coating composition using the powder compositions of this invention. Moreover, other powder compositions may be used with other thermal spray coating devices to compensate for changes in composition during deposition and obtain the desired coating composition of this invention.

The powders used in the D-Gun for applying a coating according to the present invention are preferably sintered powders. However, other forms of powder such as cast and crushed powders can also be used. Generally, the size of the powder should be about −325 mesh. Powders produced by other methods of manufacture and with other size distributions may be used according to the present invention with other thermal spray deposition techniques if they are more suited to a particular spray device and/or size.

As indicated above, it is possible to use essentially the same powder composition as heretofore employed in depositing W-Co-Cr-C coatings of the prior art. This powder composition consists essentially of about 10 weight percent cobalt, about 4 weight percent chromium, about 5 weight percent carbon and the balance tungsten. With this powder, the feed rate of both oxygen and fuel gas (e.g., acetylene) should be adjusted to provide an oxy fuel gas ratio of between about 1.1 and 1.2. This ratio is higher than that usually used heretofore with the same powder composition and provides an oxidizing mixture which reduces the carbon content of the applied coating.

At oxy-fuel gas ratios close to about 1.1, the conventional powder composition using the D-Gun process will produce coatings having a carbon content of about 3.5 weight percent. Conversely, at oxy-fuel gas mixtures close to about 1.2, this same powder will produce coatings having a lower carbon content of about 3.1 weight percent.

When oxy-fuel gas ratios of 1.0 or slightly lower (e.g. 0.98) are used, the powder composition must be modified in order to produce coatings of the present invention. A preferred powder composition consists essentially of from about 6.5 to about 9.0, say, about 7.0 to about 9.0, weight percent cobalt; from about 2.0 to 4.0, say about 3.0 to about 4.0, weight percent chromium; from about 3.0 to about 4.0 weight percent carbon and the balance tungsten. The powder composition may also contain iron and free carbon, e.g., each in amounts up to about 0.5 weight percent.

Sometimes the powder composition may comprise about 7.0 to about 8.5 weight percent cobalt, about 2.5 to about 3.5 weight percent chromium, about 3.0 to about 4.0 weight percent carbon and the balance tungsten, e.g., about 7.7 weight percent cobalt, about 3.5 weight percent chromium, about 3.8 weight percent carbon and the balance tungsten.

Alternatively, the coating of the present invention can be applied to a substrate by plasma arc spray or other thermal spray techniques. In the plasma arc spray process, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. Powdered coating material is injected into the high thermal content effluent nozzle and is deposited onto the surface to be coated. This process, which is described in U.S. Pat. No. 2,858,411, supra, produces a deposited coating which is sound, dense and adherent to the substrate. The applied coating also consists of irregularly shaped microscopic splats or leaves which are interlocked and mechanically bonded to one another and also to the substrate.

In those cases where the plasma arc spray process is used to apply the coatings in the present invention, powders fed to the arc torch may have essentially the same composition as the applied coating itself. With some plasma arc or other thermal spray equipment, however, some change in composition is to be expected, and, in such cases, the powder composition may be adjusted accordingly to achieve the coating composition of the present invention.

The coatings of the present invention may be applied to almost any type of substrate, e.g., metallic substrates such as iron or steel or non-metallic substrates such as carbon, graphite and polymers, for instance. Some examples of substrate material used in various environments and admirably suited as substrates for the coatings of the present invention include, for example, steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals and refractory-metal base alloys.

Although the composition of the coatings (i.e., when applied) of the present invention may vary within the ranges indicated above, the preferred coating composition consists essentially of from about 7.0 to about 8.5 weight percent cobalt, from about 2.5 to about 3.5 weight percent chromium, from about 3.0 to about 4.0 weight percent carbon and the balance tungsten. Such coatings are ideally suited for industrial valves, mechanical seals, bushings and the like. They are also ideally suited for use in the textile industry as crimper rolls, for example.

The microstructure of the coatings of the present invention are very complex and not completely understood. However, it is believed that the major portion of the coatings consist essentially of a mixture of WC and $(W,Cr,Co)_2C$ with other metal carbides and possibly metallic phases. Despite the lower volume fraction of carbides present as compared to similar coatings of the prior art, the coatings of the present invention surprisingly exhibit improved wear resistance without sacrificing other desirable characteristics such as hardness, toughness, etc. Typical hardness values for coatings of the present invention exceed about 900 $DPH_{300}$.

The following examples will serve to further illustrate the practice of the present invention.

EXAMPLE I

Specimens of AISI 1018 steel were cleaned and prepared for coating as follows: The surface on one side of each specimen was ground smooth and parallel to the opposite side. The surface was then grit blasted with 60 mesh $Al_2O_3$ to a surface roughness of about 120 microinch RMS. All the specimens were then coated according to the prior art using a detonation gun (D-Gun) and a sintered powder of the following composition: 10 weight percent Co, 4 weight percent Cr, 5.2 weight percent C and the balance W. The size of the powders was about −325 mesh. Acetylene was used as the fuel gas. The oxy-fuel gas ratio was 0.98.

A chemical analysis of the coating showed the following composition: 8 weight percent Co, 3.2 weight percent Cr, 4.7 weight percent C and the balance W. The chemical analysis was carried out principally by two methods. Carbon was analyzed by a combustion analysis technique using a Leco Carbon Analyzer and volumetric determination of gaseous output. Cobalt and chromium were analyzed by first fusing the sample in $Na_2O_2$ and separating the cobalt and chromium, then determining the amount of each potentiometrically.

Abrasive wear properties of the applied coating were determined using the standard dry sand/rubber wheel abrasion test described in ASTM Standard G65-80, Procedure A. In this test, the specimen was loaded by means of a lever arm against a rotating wheel with a chlorobutyl rubber rim around the wheel. An abrasive (i.e., 50–70 mesh Ottawa Silica Sand) was introduced between the specimen and the rubber wheel. The wheel was rotated in the direction of the abrasive flow. The test specimen was weighed before, after and periodically during the test, and its weight loss was recorded. Because of the wide differences in the densities of different materials tested, the mass loss is normally converted to volume loss to evaluate the relative ranking of materials. The average volume loss for these specimens (conventional W-Co-Cr-C coating) was 1.7 $mm^3$ per 1,000 revolutions.

The hardness of these specimens was also measured by standard methods. The average hardness was found to be 1100 $DPH_{300}$. The specimens were also easily ground to a smooth finish using the normal method of finishing wear resistant coating with a diamond grinding wheel and an infeed of 0.0005 inch per pass.

EXAMPLE II

Specimens of AISI 1018 steel were prepared in the same manner as described in Example I. The specimen surfaces were then coated using a D-Gun and the same sintered powder, i.e., 10 weight percent Co, 4 weight percent Cr, 5.2 weight percent C and the balance W. The powder size was also identical, i.e., −325 mesh. Acetylene was also used as the fuel gas. In this instance, however, the oxy-fuel gas ratio in the D-Gun was 1.1 according to the present invention.

A chemical analysis of the coating showed the following composition: 7.6 weight percent Co, 2.9 weight percent Cr, 3.5 weight percent C and the balance W.

Abrasive wear tests were also carried out using the ASTM Standard G65-80, Procedure A. The average volume loss for the coated specimens was 1.1 $mm^3$ per 1,000 revolutions. This represents a significant improvement in wear resistance over the specimens of Example I.

The hardness of the specimens was also measured and found to be 1150 $DPH_{300}$. The specimens were also easily ground to a smooth finish using the normal method as in Example I.

EXAMPLE III

Specimens of AISI 1018 steel were prepared in the same manner as described in Example I. The specimen surfaces were then coated using a D-Gun and the same sintered powder, i.e., 10 weight percent Co, 4 weight percent Cr, 5.2 weight percent C and the balance W. The powder size was also identical, i.e., −325 mesh. Acetylene was also used as the fuel gas. However, the oxy-fuel gas ratio used in this instance was 1.2 according to the present invention.

A chemical analysis of the coating showed the following composition: 7.8 weight percent Co, 2.9 weight percent Cr, 3.1 weight percent C and the balance W.

Abrasive wear tests were also carried out on one specimen using the ASTM Standard G65-80. The average volume loss for this specimen was 1.1 $mm^3$ per 1,000 revolutions. This also represents a significant improvement in wear resistance over the specimens of Example I.

The hardness of the specimen was also measured and found to be 1080 $DPH_{300}$. The specimen was ground to a smooth but somewhat rougher finish using the normal method as in Example I.

EXAMPLE IV

Specimens of AISI 1018 steel were prepared in the same manner as described in Example I. The specimen surfaces were then coated using a D-Gun and the same sintered powder; i.e., 10 weight percent Co, 4 weight percent Cr, 5.2 weight percent C and the balance W. The powder size was also identical, i.e., −325 mesh. Acetylene was also used as the fuel gas. However, the oxy-fuel gas mixture used in this instance was 1.3.

A chemical analysis of the coating showed the following composition: 7.6 weight percent Co, 2.7 weight percent Cr, 2.6 weight percent C and the balance W.

The hardness of this type of coating is about 1125 $DPH_{300}$. Abrasive wear tests were carried out on this coating as in Example, I, II, and III with a volume loss of 1.5 $mm^3$ per revolution. However, attempts to grind the coating to a smooth finish were unsuccessful using the normal method as described in Example I.

EXAMPLE V

Specimens of AISI 1018 steel were prepared in the same manner as described in Example I. The specimen surfaces were then coated using a D-Gun and a cast and crushed powder of the following composition: 7.7 weight percent Co, 3.5 weight percent Cr, 3.8 weight percent C and the balance W. The powder was sized between 20 and 2 micrometers. Acetylene was also used as the fuel gas. The oxy-fuel gas ratio in the D-Gun was 0.98.

A chemical analysis of the coating showed the following composition: 8.5 weight percent Co, 3.3 weight percent Cr, 3.5 weight percent C and the balance W.

Abrasive wear tests were also carried out using ASTM Standard G65-80, Procedure A. The average volume loss for the specimens was 1.1 $mm^3$ per 1000 revolutions. This represents a significant improvement in wear resistance over the specimens of Example I.

The hardness of the coating was also measured and found to be 1275 $DPH_{300}$. The coating on the specimens was also easily ground to a smooth finish using the normal method as in Example I.

EXAMPLE VI

Specimens of AISI 1018 steel were prepared in the same manner as described in Example I. The specimen surfaces were then coated using a plasma spray torch and a same sintered powder containing 10 weight percent Co, 4 weight percent Cr, 5.2 weight percent C and the balance W. The powder size was also −325 mesh.

A chemical analysis of the coating showed the following composition: 9.2 weight percent Co, 3.5 weight percent Cr, 5.0 weight percent C and the balance W. The cobalt and carbon content of this coating was higher than that of the coatings of the present invention.

Abrasive wear tests were also carried out using the ASTM Standard G65-80, Procedure A. The average volume loss for the coated specimen was 9.3 $mm^3$ per 1,000 revolutions. The wear properties of this coating were poor even when compared against the wear properties of the conventional D-Gun coatings of Example I. This is to be expected in the case of plasma spray coatings which do not wear as well as D-Gun coatings.

The hardness of the specimen was also measured and found to be 687 $DPH_{300}$.

EXAMPLE VII

Specimens of AISI 1018 steel were prepared in the same manner as described in Example I. The specimen surfaces were then coated using a plasma spray torch and a sintered powder of the following composition: 10.9 weight percent Co, 4.3 weight percent Cr, 3.8 weight percent C and the balance W. The powder size was −325 mesh.

A chemical analysis of the coating showed the following composition: 8.6 weight percent Co, 3.6 weight percent Cr, 3.4 weight percent C and the balance W. This coating composition was within the scope of the present invention.

Abrasive wear tests were also carried out using the ASTM Standard G65-80, Procedure A. The average volume loss for this coating specimen was 4.1 per 1,000 revolutions. The wear rate for this coating was less than half the wear rate for the plasma spray coating of the previous example using a conventional powder.

The hardness of the coated specimen was also measured and found to be 830 $DPH_{300}$.

Although the powder and coating compositions have been defined herein with certain specific ranges for each of the essential components, it will be understood that minor amounts of various impurities may also be present. Iron is usually the principal impurity in the coating resulting from grinding operations and may be present in amounts up to about 1.5 and in some cases 2.0 weight percent of the composition.

Although the foregoing examples include only D-Gun and plasma spray coatings, it will be understood that other thermal spray techniques such as "high velocity" plasma, "hypersonic" combustion spray processes or various other detonation devices may be used to produce coatings of the present invention.

We claim:

1. A coating composition which has been applied to a substrate by a thermal spray process which consists essentially of from about 6.5 to about 9.0 weight percent cobalt, from about 2.0 to about 4.0 weight percent chromium, from about 3.0 to about 4.0 weight percent carbon and the balance tungsten.

2. A coating composition according to claim 1 consisting essentially of from about 7.0 to about 8.5 weight percent cobalt, from about 2.5 to about 3.5 weight percent chromium, from about 3.0 to about 4.0 weight percent carbon and the balance tungsten.

3. A coating composition according to claim 1 having a hardness value in excess of 900 $DPH_{300}$.

4. A coating composition according to claim 1 wherein the substrate is a metallic material selected from the group consisting of steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals, and refractory-metal base alloys.

5. A coating composition according to claim 1 wherein the substrate is a non metallic material selected from the group consisting of carbon, graphite and polymers.

6. An article comprising a substrate and a coating composition applied to said substrate by a thermal spray process, said coating composition which has been applied consisting essentially of from about 6.5 to about 9.0 weight percent cobalt, from about 2.0 to about 4.0 weight percent chromium, from about 3.0 to about 4.0 weight percent carbon and the balance tungsten.

7. An article according to claim 6 wherein said coating composition consists essentially of from about 7.0 to about 8.5 weight percent cobalt, from about 2.5 to about 3.5 weight percent chromium, from about 3.0 to about 4.0 weight percent carbon and the balance tungsten.

8. An article comprising a substrate and a coating composition applied to said substrate by a D-Gun deposition process, wherein said coating composition which has been applied consists essentially of from about 6.5 to about 9.0 weight percent cobalt, from about 2.0 to about 4.0 weight percent chromium, from about 3.0 to about 4.0 weight percent carbon and the balance tungsten, and wherein said coating has a hardness value in excess of about 900 $DPH_{300}$, an average volume loss of about 1.1 $mm^3$ per 1000 revolutions when subjected to a standard dry sand/rubber wheel abrasion test and which is easily ground to a smooth finish.

9. An article according to claim 10 wherein the major portion of said coating composition comprises a mixture of WC and $(W,Cr,Co)_2C$.

10. An article comprising a substrate and a coating composition applied to said substrate by a plasma spray process, wherein said coating composition which has been applied consists essentially of from about 6.5 to about 9.0 weight percent cobalt, from about 2.0 to about 4.0 weight percent chromium, from about 3.0 to about 4.0 weight percent carbon and the balance tungsten, and wherein said coating has a hardness value in excess of about 830 $DPH_{300}$, an average volume loss of about 4.1 $mm^3$ per 1000 revolutions when subjected to a standard dry sand/rubber wheel abrasion test and which is easily ground to a smooth finish.

11. An article according to claim 10 wherein the major portion of said coating composition comprises a mixture of WC and $(W,Cr,Co)_2C$.

12. A powdered coating composition for applying a wear and corrosion resistant coating to a substrate by a thermal spray process consisting essentially of from about 6.5 to about 9.0 weight percent cobalt, from about 2.0 to about 4.0 weight percent chromium, from about 3.0 to about 4.0 weight percent carbon and the balance tungsten.

13. A powdered coating composition according to claim 12 consisting essentially of from about 7.0 to about 8.5 weight percent cobalt, from about 2.5 to about 3.5 weight percent chromium, from about 3.0 to about 4.0 weight percent carbon and the balance tungsten.

14. A powdered coating composition according to claim 12 consisting of sintered powder.

15. A powdered coating composition according to claim 12 consisting essentially of from about 7.0 to about 9.0 weight percent cobalt from about 3.0 to about 4.0 weight percent chromium, from about 3.0 to about 4.0 weight percent carbon and the balance tungsten.

16. A powdered coating composition according to claim 15 consisting essentially of about 7.7 weight percent cobalt, about 3.5 weight percent chromium, about 3.8 weight percent carbon and the balance tungsten.

17. In a method for coating a substrate wherein a powdered coating material is suspended within a high temperature, high velocity gaseous stream and heated to a temperature at least close to the melting point thereof, said gaseous stream being directed against a surface of said substrate to deposit said powdered coating material and form a coating thereon, the improvement for increasing the wear resistance of said coating, said improvement comprising a powdered coating material having a composition such that the coating composition which has been deposited onto said substrate consists essentially of from about 6.5 to about 9.0 weight percent cobalt, from about 2.0 to about 4.0 weight percent chromium, from about 3.0 to about 4.0 weight percent carbon and the balance tungsten.

18. A method according to claim 17 wherein the powdered coating material has a composition such that the coating composition which has been deposited onto said substrate consists essentially of from about 7.0 to about 8.5 weight percent cobalt, from about 2.5 to about 3.5 weight percent chromium, from about 3.0 to about 4.0 weight percent carbon and the balance tungsten.

19. A method according to claim 17 wherein the powdered coating material is suspended within a high temperature, high velocity gaseous stream produced by a detonation device.

20. A method according to claim 17 wherein the powdered coating material has a composition consisting essentially of from about 6.5 to about 9.0 weight percent cobalt, from about 2.0 to about 4.0 weight percent chromium, from about 3.0 to about 4.0 weight percent carbon and the balance tungsten.

21. A method according to claim 20 wherein the powdered coating material has a composition consisting essentially of from about 7.0 to about 9.0 weight percent cobalt from about 3.0 to about 4.0 weight percent chromium, from about 3.0 to about 4.0 weight percent carbon and the balance tungsten.

22. A method according to claim 12 wherein the powdered coating material is suspended within a high temperature, high velocity gaseous stream produced by plasma arc torch.

23. A method according to claim 22 wherein the powdered coating material has a composition which is substantially the same as the composition of said coating.

24. A method for coating a substrate comprising: feeding a mixture of oxygen and a fuel gas into the barrel of a detonation gun along with a powdered coating material; igniting the oxygen and fuel gas mixture to produce a detonation wave along the length of said barrel which accelerates said powdered coating material in a high temperature, high velocity gaseous stream; and directing said gaseous stream against a surface of said substrate to deposit said powdered coating material and form a coating thereon, said powdered coating material having a composition such that the coating deposited onto said substrate consists essentially of from about 6.5 to about 9.0 weight percent cobalt, from about 2.0 to about 4.0 weight percent chromium, from about 3.0 to about 4.0 weight percent carbon and the balance tungsten.

25. A method according to claim 24 wherein the powdered coating material has a composition such that the coating deposited onto said substrate consists essentially of from about 7.0 to about 8.5 weight percent cobalt, from about 2.5 to about 3.5 weight percent chromium, from about 3.0 to about 4.0 weight percent carbon and the balance tungsten.

26. A method according to claim 24 wherein the ratio of oxygen to fuel gas in said mixture is approximately 1.0.

27. A method according to claim 26 wherein the powdered coating material has a composition consisting essentially of from about 7.0 to about 9.0 weight percent cobalt, from about 3.0 to about 4.0 weight percent chromium, from about 3.0 to about 4.0 weight percent carbon and the balance tungsten.

28. A method according to claim 27 wherein the powdered coating material has a composition consisting essentially of about 7.7 weight percent cobalt, about 3.5 weight percent chromium, about 3.8 weigh percent carbon and the balance tungsten.

29. A method according to claim 24 wherein the ratio of oxygen to fuel gas in said mixture is between about 1.1 and 1.2.

30. A method according to claim 29 wherein the powdered coating material has a composition consisting essentially of about 10 weight percent cobalt, about 4 weight percent chromium, about 5.2 weight percent carbon and the balance tungsten.

* * * * *

UNITED STATES PATENT AND TRADEMARK OFFICE

CERTIFICATE OF CORRECTION

PATENT NO. : 4,626,477

DATED : December 2, 1986

INVENTOR(S) : JOHN E. JACKSON, THOMAS A. ADLER, JEAN M. QUETS

It is certified that error appears in the above-identified patent and that said Letters Patent is hereby corrected as shown below:

In Claim 9, line 1, "claim 10" should be --claim 8--, and

In Claim 22, line 1, "claim 12" should be --claim 17--.

Signed and Sealed this

Thirty-first Day of March, 1987

*Attest:*

DONALD J. QUIGG

*Attesting Officer*

*Commissioner of Patents and Trademarks*